United States Patent [19]

Potter

[11] Patent Number: 4,565,319

[45] Date of Patent: Jan. 21, 1986

[54] FUEL INJECTION UNIT

[75] Inventor: James C. Potter, London, England

[73] Assignee: Lucas Industries public limited company, Birmingham, England

[21] Appl. No.: 712,644

[22] Filed: Mar. 18, 1985

[30] Foreign Application Priority Data

Mar. 23, 1984 [GB] United Kingdom ..... 8407579

[51] Int. Cl.[4] ..... F02M 47/00

[52] U.S. Cl. ..... 239/88; 123/510; 417/490

[58] Field of Search ..... 123/510; 239/88, 89, 239/90, 91, 92, 93, 94, 95, 96; 417/490, 494, 499

[56] References Cited

U.S. PATENT DOCUMENTS

| | | | |
|---|---|---|---|
| 2,144,862 | 1/1939 | Truxell, Jr. | 239/88 |
| 3,216,359 | 11/1965 | Teichert | 239/90 X |
| 3,409,225 | 11/1968 | Maddalozzo et al. | 239/89 |
| 4,244,520 | 1/1981 | Rathmayr | 239/88 |

*Primary Examiner*—Leonard E. Smith

[57] ABSTRACT

A fuel injection unit includes a body housing a high pressure fuel pump, the body having a stepped cylindrical portion 11 to which a nozzle head is attached by a cap nut having a skirt portion. A fuel supply port opens onto a step and located against the step is a ring member the surface of which presented to the step defines an annular recess. Inner and outer annular legs are defined by the recess and the inner leg engages the step and the outer leg has a clearance with the step, the clearance forming a filtration gap for fuel flowing to the supply port.

4 Claims, 2 Drawing Figures

FUEL INJECTION UNIT

This invention relates to a fuel injection unit for supplying fuel to a combustion chamber of a compression ignition engine, the unit being of the kind comprising a body defining a stepped cylindrical portion, a nozzle head which is secured to an end of the cylindrical portion by means of a cap nut which has a screw threaded skirt portion engaged with a screw thread on said cylindrical portion, said cylindrical portion, said nozzle head and said cap nut being located in use in a bore in the cylinder head of the associated engine, pump means located in the body to supply fuel at high pressure to the nozzle head, the wall of the bore having a fuel feed port formed therein, a supply port formed in said body for communication with said feed port, whereby fuel can be supplied to said pump means.

The pump means can take the form of an engine actuated reciprocable plunger pump but whatever form the pump means takes, it is essential that the fuel flowing to the pump should be as free from contaminant as possible. Fuel supply systems for compression ignition engines employ paper or like filters to trap particles of contaminant contained in the fuel as supplied to the associated fuel tank. However, it is possible for particles of material to become detached from the walls of pipes and passages connecting the filter with the pump means. Such particles of contaminant can cause damage to the working clearances of the pump and nozzle and can block the very fine outlet orifices of the nozzle.

The object of the invention is to provide a fuel injection unit of the kind specified in a simple and convenient form.

According to the invention in a fuel injection unit of the kind specified the cylindrical portion of the body defines a step, the unit further including a ring member located about said cylindrical portion of the body, said ring member defining a clearance with said step, said clearance defining a filtration gap with said step for fuel flowing to the supply port.

An example of a fuel injection unit in accordance with the invention will now be described with reference to the accompanying drawings in which.

Figure 1:
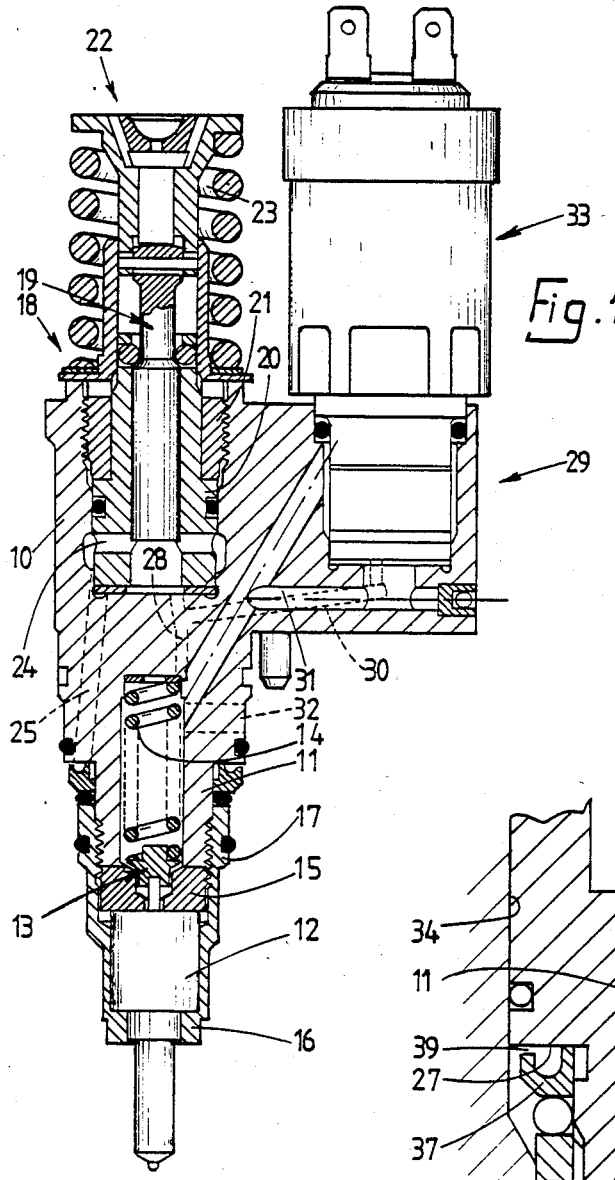
FIG. 1 is a part sectional side elevation of the nozzle unit.

Referring to FIG. 1 of the drawings the nozzle unit comprises a body 10 which defines a stepped cylindrical portion 11. Also provided is a nozzle head 12 of conventional construction and incorporating a fuel pressure actuated valve member which projects from the end of the nozzle head for engagement with a spring abutment 13 against one end of which locates a coiled compression spring 14 which is housed within a chamber in the body. Interposed between the end of the body and the nozzle head, is a distance member 15 and the distance member, the nozzle head and the cylindrical portion are held in assembled relationship by means of a cap nut 16. The cap nut 16 has a skirt portion 17 which is formed on its internal peripheral surface with a screw thread for engagement with a complementary thread formed on the portion 11 of the body.

The body also mounts a high pressure fuel pump which is generally indicated at 18 and which includes a reciprocable plunger 19 which is housed within a bore formed in a pump barrel 20, the latter being retained within a complementary recess in the body 10 by means of a retaining nut 21. The plunger is connected to a tappet assembly generally indicated at 22 and which in use, is engaged by a cam or rocker arm driven by the associated engine. The tappet assembly and plunger are moved inwardly against the action of a return spring 23. Formed in the wall of the barrel 20 is a pair of filling ports 24 which communicate with a gallery surrounding the barrel and which in turn communicates with a fuel supply passage 25 which as more clearly shown in FIG. 2, opens in a supply port 26, on a radial step 27 defined on the cylindrical portion 11 of the body.

The pump chamber communicates by way of a passage 28, extending through the cylindrical portion 11 of the body, the distance piece 15 and the nozzle head 12, with a supply gallery formed in the nozzle head. When fuel under pressure is supplied by the high pressure pump during movement of the plunger 19 against the action of the spring, and when the ports 24 have been covered, the fuel pressure acting on the valve member will lift the valve member against the action of the spring 14 to permit fuel flow through outlet orifices defined in the nozzle head. Such flow of fuel can occur providing a spill control valve generally indicated at 29, is in the closed position. The spill valve is connected to the passage 28 by a passage which is shown in dotted outline at 30, and when the valve 29 is open, the fuel pressure in the passage 28 is insufficient to cause lifting of the valve member, the fuel returning by way of a passage 31, to a spill outlet 32 formed in the cylindrical portion of the body. The spill valve 29 is controlled by an electromagnetic actuator which is generally indicated at 33 and the supply of current to the actuator is controlled by an electronic control system not shown.

Figure 2:
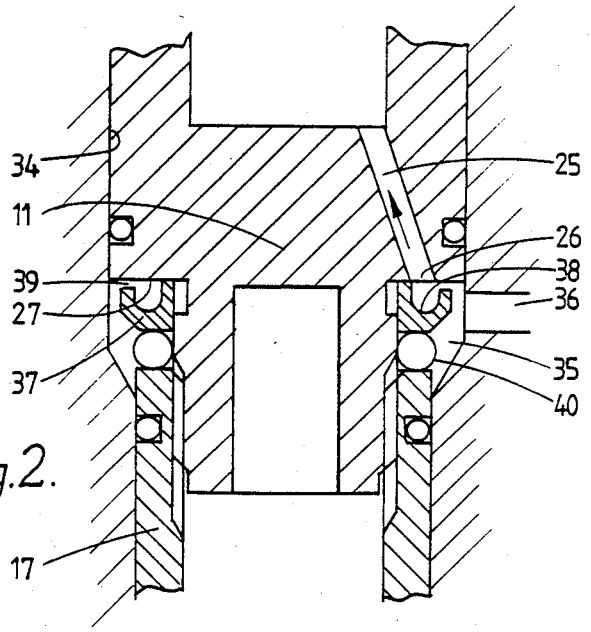
FIG. 2 is a view to an enlarged scale of a portion of the nozzle unit seen in FIG. 1 fitted within a bore in the cylinder head of an associated engine.

The cylindrical portion of the body together with the nozzle head is intended to be mounted in a bore formed in the cylinder head of the associated engine. FIG. 2 shows a portion of the bore which is referenced 34 and it defines with the cylindrical portion 11 of the body when the latter is in position, an annular inlet chamber 35 to which fuel is supplied through a supply port 36 from a convenient source of fuel at a low pressure. The port 26 opens into the inlet chamber 35 so that fuel will be supplied to the pumping chamber of the pump when the ports 24 are uncovered by the plunger during the movement thereof under the action of the spring 23.

In order to minimise the risk of contaminant entering into the pump chamber and the nozzle such as could cause damage to the working surfaces thereof, there is mounted about the cylindrical portion 11 of the body a ring member 37. In the face of the ring member which is presented to the step 27 there is defined an annular recess 38 so that the ring member defines two annular legs and has a substantially "U" shaped cross section. The inner leg locates against the step 27 but the outer leg is machined so that it terminates short of the step 27 and defines a clearance gap 39 through which fuel must flow from the chamber 35 to the port 26. The width of the gap is carefully chosen so as to trap in the chamber 35, particles of contaminant such as might cause damage to the working surfaces of the pump. It will be appreciated that the gap 39 is annular and therefore the width of the gap can be comparatively small without imposing too much restriction on the flow of fuel. Conveniently, the ring member is retained against the step by means of an annular elastomeric member 40 which is disposed between the ring member and the adjacent end face of the skirt 17 of the cap nut. The ring member 37 may be formed from magnetized material so that ferrous particles will adhere to the ring member.

I claim:

1. A fuel injection unit for supplying fuel to a combustion chamber of a compression ignition engine, comprising a body defining a stepped cylindrical portion, a nozzle head, a cap nut serving to secure the nozzle head to an end of the cylindrical portion of the body, said cap nut having a screw threaded skirt portion which is engaged with a screw thread on said cylindrical portion, said cylindrical portion, said nozzle head and said cap nut being located in use in a bore in the cylinder head of the associated engine, pump means located in the body to supply fuel at high pressure to the nozzle head, the wall of the bore having a fuel feed port formed therein, a supply port formed in the body for communication with said feed port whereby fuel can be supplied to said pump means, characterized in that the cylindrical portion of the body defines a step, the unit further including a ring member located about said cylindrical portion of the body, said ring member defining a clearance with said step, said clearance defining a filtration gap with said step for fuel flowing to the supply port.

2. A unit according to claim 1 characterized in that said step is radial and said supply port opens onto said step, said ring member having an annular recess formed in its face presented to the step thereby defining inner and outer annular legs, the inner leg engaging said step and the outer leg defining said clearance with the step at a position outwardly of said supply port.

3. A unit according to claims 2 characterized in that said inner annular leg is held in engagement with said step by an annular member formed from elastomeric material located between the ring member and the adjacent end face of the skirt portion of the cap nut.

4. A unit according to claims 1, 2 or 3 characterized in that said ring member is formed from magnetized material.

* * * * *